US006572446B1

(12) United States Patent
Osterheld et al.

(10) Patent No.: US 6,572,446 B1
(45) Date of Patent: Jun. 3, 2003

(54) CHEMICAL MECHANICAL POLISHING PAD CONDITIONING ELEMENT WITH DISCRETE POINTS AND COMPLIANT MEMBRANE

(75) Inventors: Thomas H. Osterheld, Mountain View, CA (US); Manoocher Birang, Los Gatos, CA (US); Robert D. Tolles, Santa Jose, CA (US); Steven Zuniga, Soquel, CA (US); Charles C. Garretson, Palo Alto, CA (US)

(73) Assignee: Applied Materials Inc., Santa Clara, CA (US)

( * ) Notice: Subject to any disclaimer, the term of this patent is extended or adjusted under 35 U.S.C. 154(b) by 31 days.

(21) Appl. No.: 09/664,603

(22) Filed: Sep. 18, 2000

(51) Int. Cl.[7] ..... B24B 51/00

(52) U.S. Cl. ..... 451/24; 451/56; 451/443; 451/444

(58) Field of Search ..... 451/443, 444, 451/56, 5, 24, 285–290

(56) References Cited

U.S. PATENT DOCUMENTS

| | | | | |
|---|---|---|---|---|
| 5,216,843 A | | 6/1993 | Breivogel et al. | |
| 5,456,627 A | | 10/1995 | Jackson et al. | |
| 5,486,131 A | | 1/1996 | Cesna et al. | |
| 5,531,635 A | * | 7/1996 | Mogi et al. | 451/443 |
| 5,547,417 A | | 8/1996 | Breivogel et al. | |
| 5,605,499 A | * | 2/1997 | Sugiyama et al. | 451/41 |
| 5,655,951 A | * | 8/1997 | Meikle et al. | 451/41 |
| 5,885,137 A | * | 3/1999 | Ploessl | 451/56 |
| 5,885,147 A | * | 3/1999 | Kreager et al. | 451/443 |
| 5,902,173 A | * | 5/1999 | Tanaka | 451/287 |
| 5,957,754 A | | 9/1999 | Brown et al. | |
| 5,964,653 A | | 10/1999 | Perlov et al. | |
| 6,019,670 A | | 2/2000 | Cheng et al. | |
| 6,024,630 A | | 2/2000 | Shendon et al. | |
| 6,027,659 A | | 2/2000 | Billett | |
| 6,036,583 A | | 3/2000 | Perlov et al. | |
| 6,190,243 B1 | * | 2/2001 | Wada et al. | 451/285 |
| 6,213,852 B1 | * | 4/2001 | Fujii et al. | 451/285 |
| 6,234,868 B1 | * | 5/2001 | Easter et al. | 451/288 |
| 2001/0009844 A1 | * | 7/2001 | Cho et al. | 451/443 |

* cited by examiner

*Primary Examiner*—M. Rachuba
(74) *Attorney, Agent, or Firm*—Moser, Patterson & Sheridan

(57) ABSTRACT

A pad conditioning assembly includes a conditioner head with an end effector movable into contact with a polishing pad,a plurality of downwardly-projecting movable conditioning elements disposed at a bottom of the end effector; and a compliant backing member disposed above and adjacent the conditioning elements, wherein forces applied by the compliant backing member are transferred to the movable conditioning elements to move the conditioning elements. In one aspect, a pressurization circuit applies a pressure from a pressure source to the compliant backing member to flex the compliant backing member against the movable conditioning elements.

42 Claims, 3 Drawing Sheets

CHEMICAL MECHANICAL POLISHING PAD CONDITIONING ELEMENT WITH DISCRETE POINTS AND COMPLIANT MEMBRANE

FIELD OF THE INVENTION

The present invention relates to the field of semiconductor processing; and more specifically to the field of conditioning methods and apparatuses for polishing pads used in the planarization of thin films formed on a semiconductor substrate.

BACKGROUND ART

Current integrated circuits (ICs) rely upon an elaborate system of metallization interconnects to couple various devices fabricated in and on the semiconductor substrate. These metallization interconnects are commonly formed, for example, by depositing aluminum or some other metal and (i.e., a first metal layer) then patterning the deposited metals to form interconnection paths along the surface of the silicon substrate. A dielectric or insulated layer, such as a chemical vapor deposition layer of (CVD) silicon dioxide, is then deposited over the first metal layer. The dielectric layer conformably covers the patterned first metal layer such that the upper surface of the dielectric layer is characterized by a series of non-planar "steps" which correspond in height and width to the underlying patterned first metal layer. Openings, or vias, are then etched through the dielectric layer and a second metal layer is deposited on the dielectric layer so as to fill the via openings and complete an electrical connection (i.e., the metallization interconnects) between selected portions of the second metal layer and the first metal layer.

Step height variations in the upper surface of the inter-layer dielectric are undesirable. For example, steps create a non-planar dielectric surface, which interferes with the optical resolution of subsequent photolithography processing steps and makes it extremely difficult to print high-resolution lines. In other words, if the upper surface of the substrate is non-planar, then a photoresist layer placed thereon is also non-planar and the maximum height difference between the peaks and valleys of the outer surface may exceed the depth of focus of the imaging apparatus. Therefore, various techniques have been developed to planarize the upper surface of the dielectric layer.

Chemical mechanical polishing is one accepted method of planarization. A conventional approach employs an abrasive polishing to remove the protruding steps along the upper surface of the dielectric. According to this method, a silicon substrate or wafer is forced faced down by quill on a table covered with flat pad coated with an abrasive material (slurry). Both wafer and table are rotated relative to each other under pressure to remove the protruding steps. The abrasive polishing process continues until the upper surface of the dielectric layer is planarized. However, the surface of the polishing pads used for wafer planarization quickly degrade or "glaze" and are unable to consistently provide a desired polishing rate and uniformity. Glazing occurs when the polishing pad is heated and compressed in regions where the substrate is pressed against the polishing pad. The peaks of the polishing pad are pressed down and the pits of the polishing pad are filled making the polishing pad surface smooth and less abrasive. Therefore, to combat "glazing" pad conditioning is performed to restore the abrasiveness of the polishing pad.

One approach to pad conditioning utilizes a diamond-impregnated disk. In this approach, the disk is pressed against the polishing pad and rotated. These diamond-impregnated disks have about 100,000 diamonds having a substantially normal statistical distribution of absolute diamond heights of diamond tips to a common reference surface, which can conveniently be defined as a plane parallel to the disk surface which intersects the lowest point on the metal substrate surface, but may be defined relative to any other convenient reference point(s).

However, diamond-impregnated disks represent a significant source of CMP process variability as measured by initial removal rates, removal rate drift, and within wafer non-uniformity drift. This process variability stems from variability in the absolute diamond heights in the "working tail" portion of the diamond disk shown in FIG. 1(*a*) and depends on factors such as disk front-side flatness, diamond size, and diamond shape. The "working tail" includes diamonds with an absolute diamond height within a range of about 0.0005 inches and accounts for roughly 3% of the total diamond population. Only diamonds in this "working tail" actually see or contact the polishing pad (i.e., the absolute diamond height window). In other words, within the "working tail", the diamond with the largest absolute height sits approximately 0.0005 inches higher than the diamond with the lowest absolute diamond height that still sees or contacts the pad. The vast majority of diamonds, approximately 97%, do not contact the pad and do not contribute to pad conditioning.

Additionally, as the small percentage of diamonds having the highest absolute diamond height wear, other diamonds do not become available. The wear mechanism is a rounding of the diamond cutting edge. After rounding occurs, the diamond rides on the pad surface, but does not "cut". Given this wear mechanism and the substantially narrow absolute diamond height distribution of conventional diamond-impregnated disks, the disk cut rate decreases with disk use because the bulk diamond does not wear fast enough to introduce new cutting edges associated with diamonds disposed at slightly lower absolute diamond heights. Further, since the diamonds in the diamond-impregnated disk are not designed to break away to expose new diamonds as many other types of diamond polishing or cutting tools, the disk moves to a state where it is mostly riding on rounded diamonds.

Thus, diamond-impregnated disks suffer not only from drawbacks such as non-uniform polishing due to insufficient surface flatness or improper alignment, but exhibit decreased performance and service life due to the statistically normal distribution of absolute diamond heights and inability of all of the diamonds to contribute to the pad conditioning.

In another approach to pad conditioning, grooves are formed in a polishing pad by rotating a conditioning block having a number of discrete point contacts and moving it between an outer radius and an inner radius of the polishing pad corresponding to a wafer polishing area. These discrete point contacts, such as diamond tipped threaded shanks, extend from the bottom surface of the conditioning block and the position of the tips may be adjusted by a corresponding clockwise or counterclockwise rotation of the threaded shanks. However, it is difficult to obtain an even loading condition with discrete points mounted on a rigid conditioning blocks or disk due to uneven loadings on the discrete points caused by slight non-planarity of the tips of the discrete points (e.g., the diamond tips). This non-planarity has a deleterious effect on the conditioning uniformity, especially when the conditioning block has only a relatively small number of discrete polishing points, and is further aggravated by axial movement of the shanks caused by thermal or mechanical stresses.

Accordingly, a need exists for a pad conditioning apparatus capable of maintaining a plurality of conditioning elements at a substantially equal distribution of absolute diamond heights. Further, a need exists for a conditioning apparatus providing a substantially equal pressure distribution on the conditioning elements.

SUMMARY OF THE INVENTION

In one aspect, the invention features a pad conditioning assembly comprising a conditioner head with an end effector that is movable into contact with a polishing pad, a plurality of downwardly-projecting movable conditioning elements disposed at a bottom of the end effector; and a compliant backing member disposed above and adjacent the conditioning elements. Forces applied by the compliant backing member are transferred to the movable conditioning elements to move the conditioning elements. This aspect may also include, for example, a pressurization circuit for applying a pressure from a pressure source to the compliant backing member to flex the compliant backing member against the movable conditioning elements. The end effector may include a plurality of through holes formed in a bottom portion thereof and may include a chamber formed in an interior portion thereof adjacent the bottom portion so that at least one compliant backing member is disposed within the chamber and adjacent the bottom portion of the end effector. The plurality of movable conditioning elements may also comprise a flanged base portion, a shaft portion, and a tip portion arranged to be movable within the through holes.

In another aspect, the invention features a pad conditioning assembly comprising a conditioner head with an end effector that is movable into contact with a polishing pad, a plurality of conditioning elements, and a compliant backing member holding the conditioning elements on the end effector. This aspect may include a chamber formed within the end effector; and a pressurization circuit for supplying a pressure from a pressure source to the chamber to pressurize the chamber to a predetermined pressure, wherein the compliant backing member is disposed to cover an open portion of the chamber. Still further, the conditioning elements of this aspect may include a proximal end secured to the compliant backing member and a distal end terminating in a point, wherein pressurization of the chamber flexes the compliant backing member to provide a substantially uniform force distribution among conditioning elements engageable with a pad to be conditioned to regulate a penetration depth of the conditioning element points into the pad.

In still another aspect, the invention features a pad conditioning assembly comprising a conditioner head with an end effector that is movable into contact with a polishing pad, a plurality of downwardly-projecting pneumatically movable conditioning elements retained by the end effector, and a pressurization circuit for selectively changing a pressure within the end effector, wherein pressure changes in the end effector move the conditioning elements realtive to the end effector. The pressurization circuit may include a pressure source, a controller for controlling the chamber pressure, and a conduit between the pressure source and the end effector to provide a pressure from the pressure source to the end effector. The downwardly-projecting pneumatically movable conditioning elements may be positioned to have a substantially equal absolute diamond height.

In another aspect, the invention features a pad conditioning assembly comprising a conditioner head with an end effector movable into contact with a polishing pad and a plurality of downwardly-projecting movable conditioning elements retained by the end effector, wherein the plurality of conditioning elements are independently movable relative to the end effector during processing.

In yet another aspect, the invention features a method for conditioning a polishing surface of a polishing pad, comprising bringing a plurality of vertically movable conditioning elements having tip portions protruding from a bottom portion of the an effector and retained by the end effector into contact with the polishing pad; causing relative motion between the polishing pad and the conditioning elements, and causing relative motion between at least one of the vertically movable conditioning elements and the end effector during conditioning of the polishing pad.

Another aspect of the invention features a method for conditioning a polishing surface of a polishing pad, comprising bringing a plurality of conditioning elements that are secured by a compliant backing member to an end effector into contact with the polishing pad, and causing relative motion between the polishing pad and the conditioning elements.

Additional features of the present invention will become readily apparent to those skilled in the art from the following detailed description, wherein only preferred embodiments of the invention are shown and described, simply by way of illustration of the best mode contemplated for carrying out the invention. As will be realized, the invention is capable of other and different embodiments, and its several details are capable of modifications in various obvious respects, all without departing from the invention. The drawings and description are to be regarded as illustrative in nature, and not as restrictive.

BRIEF DESCRIPTION OF THE DRAWINGS

FIG. 1(*b*) is an illustration of an absolute diamond height distribution of one aspect of the invention.

FIG. 1 (*c*) is an illustration of an absolute diamond height distribution of another aspect of the invention.

DESCRIPTION OF THE PRESENT INVENTION

Figure 1A:
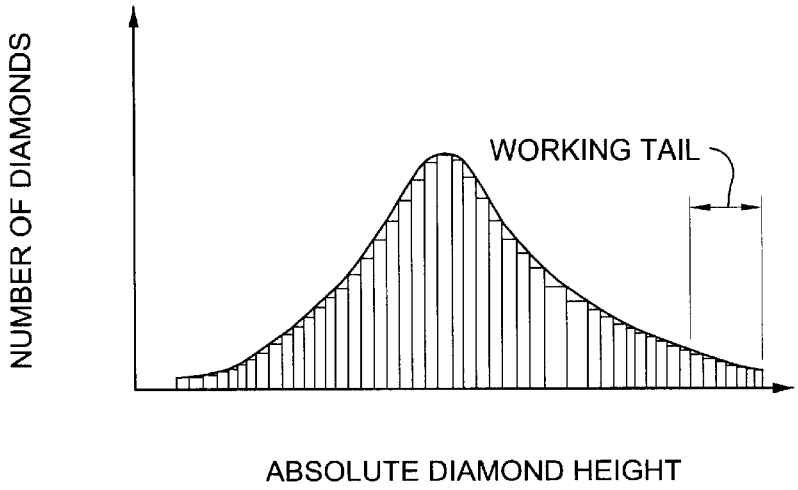
Fig. 1A (PRIOR ART)
FIG. 1(*a*) is an illustration of a conventional diamond-impregnated disk absolute diamond height distribution.
Figure 1B:
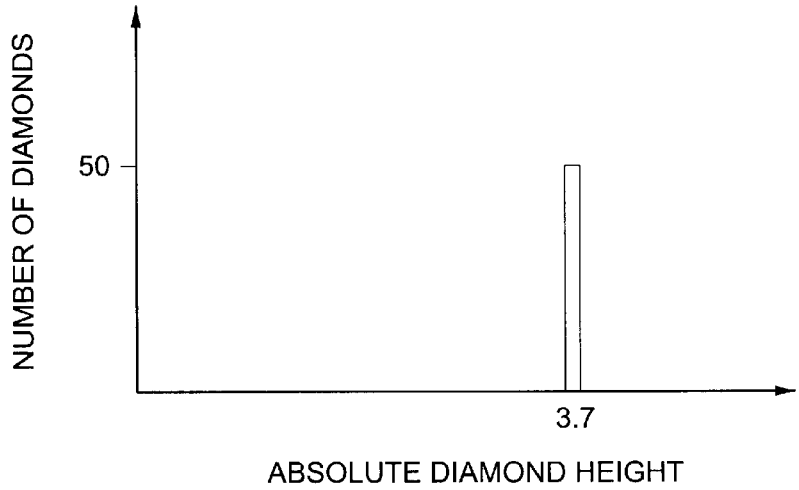
Figure 1C:
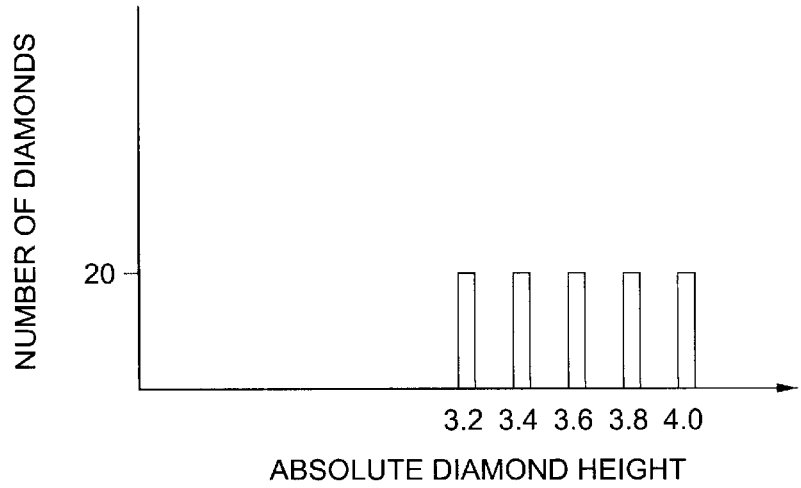

To address the above deficiencies in the background art, the pad conditioning method and apparatus of the invention provides various aspects, described herein, for achieving a substantially uniform absolute diamond height distribution of conditioning elements, a tiered absolute diamond height distribution of the conditioning elements including a plurality of groupings of a substantially equal absolute diamond height, and a substantially uniform force distribution among conditioning elements engageable with a pad to be conditioned. This control over conditioning element absolute diamond height and/or penetration depth improves pad conditioning and can extend the operating life of the polishing pad while additionally maximizing the period of time between pad conditioner service As will be appreciated by those skilled in the art based upon the following descriptions of aspects of the invention, FIG. 1(*b*) represents an aspect of the invention wherein an absolute diamond height of conditioning elements is substantially equal. The X-axis shows a magnitude of the absolute diamond height measured from a convenient reference point, such as a plane parallel to the disk surface and intersecting the lowest point on the metal substrate surface. Alternatively, this reference point could include, for example, the bottom surface of an end effector, wherein the absolute diamond height represents a distance between the tip of a diamond and the bottom surface of the end effector. The Y-axis represents an aggregate number or sample of conditioning element absolute diamond heights, which could be any number, but is preferably between 10 and 100 conditioning elements. As shown in FIG. 1(*b*), fifty conditioning elements are used and each has an absolute diamond height of approximately 3.7 mil. FIG. 1(*c*) represents an aspect of the invention wherein an absolute diamond height of conditioning elements is controlled to have a plurality of groupings of a substantially equal absolute diamond height. The X-axis shows a magnitude of the absolute diamond heights and the Y-axis represents an aggregate number or sample of conditioning element absolute diamond heights. In FIG. 1 (*c*), the absolute diamond heights are shown to vary in magnitude among several groupings of conditioning elements. As shown, five groupings of 20 conditioning elements possess respective absolute diamond heights of 4.0 mil, 3.8 mil, 3.6 mil, 3.4 mil, and 3.2 mil.

Figure 2:
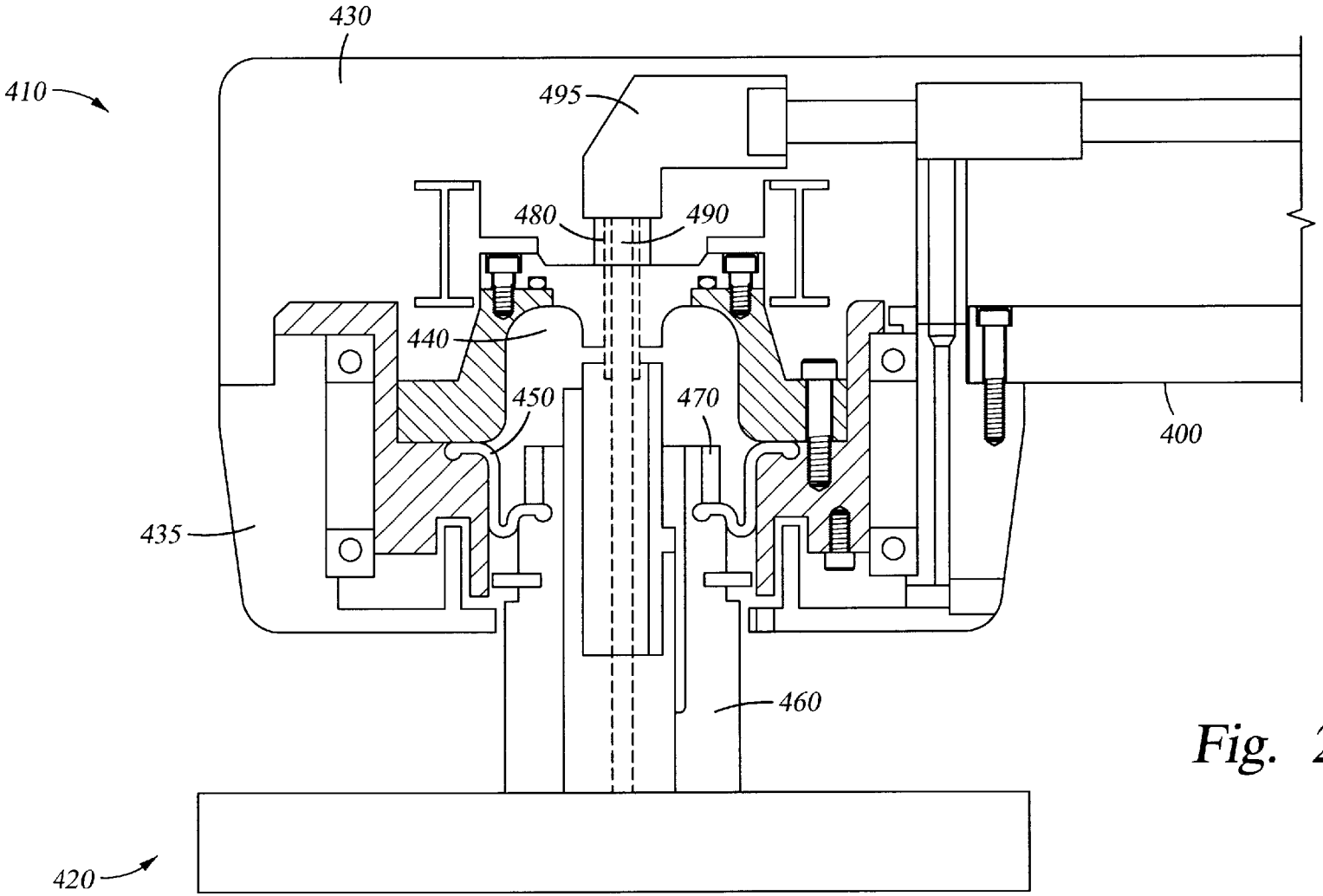
FIG. 2 shows a partial cross sectional view of a pad conditioner and end effector or the invention.

Referring to an aspect of the invention shown in FIG. 2, a support arm 400 of pad conditioner 410 has one end coupled to end effector 420 and another end coupled to a base (not shown), which may be a pivot point around which the support arm pivots or a point perpendicularly translatable along various axes. A pneumatic actuator drives the end effector 420 away from the pad conditioner 410 and retracts the end effector 420 toward the pad conditioner 410. Additionally, a variable speed electric motor may be employed to rotatably drive the end effector 420. Upper housing 430 and lower housing 435 cooperatively define an interior portion 440 functioning as a fluid cavity. The fluid cavity is further defined by fluid membrane 450 which is secured between the upper housing 430 and lower housing 435 by a suitable annular membrane clamp or rolling seal. The fluid membrane 450 is preferably a rubber material between 40 and 80 durometer in hardness. At another end, the fluid membrane 450 is connected to shaft 460 by a nut 470 screwed onto a top of shaft 460, although any suitable clamping means compressively securing that end of the fluid membrane in place is acceptable.

Fluid cavity 440 receives air, or other fluid, through fluid passage 480. Separately, fluid passage 490 provides fluid, such as air or oil, to end effector 420. In operation, fluid is forced by a pump or other pressurized source through tubes or channels in the arm 400 and base to coupling 495, which may be a rotary coupling, which couples tubes or channels in the arm 400 to corresponding fluid passages 480, 490 in the pad conditioner 410 and shaft 460 and distributes fluids thereto. Fluid passage 490 is formed through the length of the shaft 460 and extends to the coupling 495. At an upper end, fluid passages 480, 490 may be formed, for example, by positioning of a cylindrical tube within a larger bore (e.g., fluid passage 480) to create two concentric fluid passages. Various supports, supports, or elements may be used to hold the tube in place inside the bore. Alternately, the fluid passages 480, 490 may be formed adjacent one another. The build up of pressure within the interior portion drives the shaft 460 away from the pad conditioner 410. Similarly, as fluid is evacuated from the interior portion 440 the reduction in pressure forces the shaft 460 and end effector 420 toward the pad conditioner 410. The fluid delivery circuit also includes appropriate control mechanisms, valves, and regulators, known to those having skill in the art, to supply a fluid through port 590 at an appropriate pressure P to a selected chamber 530 to pressurize the chamber to a controlled pressure. For example, the fluid delivery circuit is provided to pressurize the end effector chamber 530 to a pressure between approximately 1 and 20 psi, as discussed below.

Figure 3:
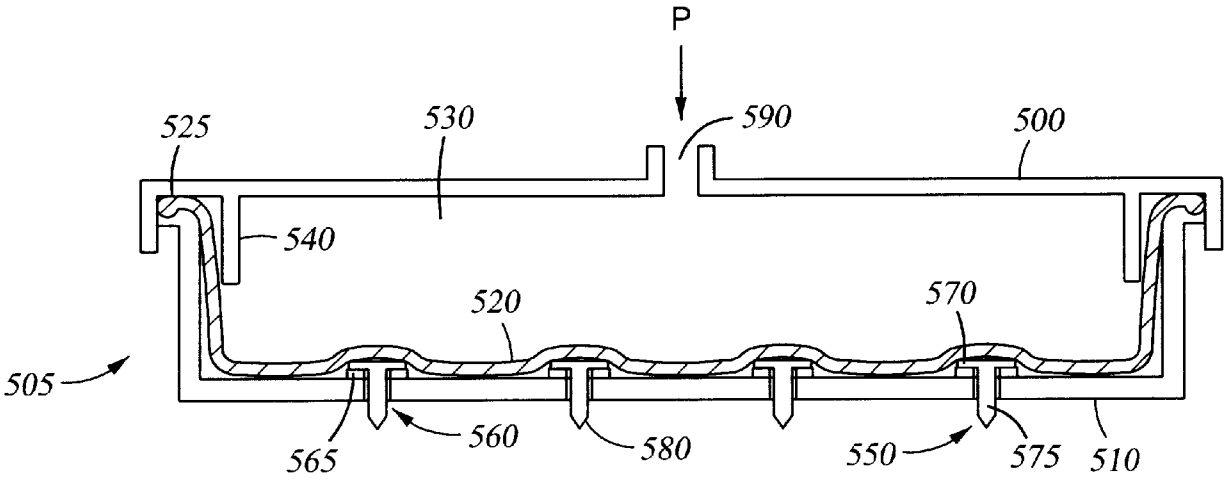
FIG. 3 shows an embodiment of an end effector of the present invention.

FIG. 3 illustrates a simplified view of one embodiment of the end effector 505 of the present invention. The end effector 505 has a top portion 500 and a bottom portion 510 connected by bolts and defining a chamber 530 therebetween. Other clamping means, such as male and female locking components or even threaded connections could also be used. Top portion 500 and a bottom portion 510 35 cooperatively form a membrane clamp 525 securing the ends of a compliant membrane or compliant backing member 520. The compliant membrane 520 extends substantially from one end of the end effector 505 to the other end thereof and is disposed, in part by partitions 540, to lie substantially adjacent the bottom portion 510 of the end effector 505.

The bottom portion 510 of end effector 505 is punctuated by a plurality of through holes 560 uniformly distributed across the bottom portion 510, although this embodiment does encompass other non-uniform distributions of the through holes 560. Within these through holes 560 are inserted conditioning elements 550 which extend from the bottom portion 550 to contact a polishing pad disposed beneath the end effector 505. The conditioning elements 550 include a base portion 570 including a flange, a shaft portion 575 movably disposed within a respective through hole, and a tip portion 580 protruding from the bottom portion 510. Compliant inserts 565 made of a resilient material such as rubber are disposed about the through holes 560 and are disposed to abut against the flanges of the conditioning element 550 base portions 570. The conditioning elements 550, namely the tip portion 580, serve as cutting elements to appropriately condition polishing pads after use to remove surface irregularities and achieve a planar pad surface. In operation, the chamber 530 is pressurized to a predetermined pressure between approximately 1 and 20 psi. The compliant membrane 520 is urged toward the base portions 570 to press conditioning elements 550 outwardly from the bottom of the end effector 505.

To tailor the pad conditioning action of the end effector 505 to particular applications and conditions, through holes 560 and corresponding conditioning elements 550 may be aggregated in particular locations or may be distributed in a higher density toward an inner diameter of the bottom portion than toward an outer diameter thereof. In this embodiment, between 10 and 100 conditioning elements are used. In this manner, the amount of conditioning for selected areas of the pad may be influenced by the placement of the conditioning elements 550 with a corresponding effect on the film removal ability of the polishing pad is those selected areas. Further, the lengths of the shaft portions 575 of conditioning elements 550 may be varied and apportioned to create a plurality of grouped absolute diamond heights so that as one tier of conditioning element 550 tips reach a predetermined level of wear or rounding, a subsequent tier of conditioning elements having a slightly lower absolute diamond height becomes engageable with a polishing pad. For example, using the example in FIG. 1(*c*), one tier of conditioning elements 550 may possess an absolute diamond height of 4.0 mil with each subsequent tier of conditioning elements decremented by an additional 0.2 mil.

The conditioning members may be formed from a metal, a metal alloy, a carbide, or a ceramic. For example, a nickel chrome alloy or a nickel plated carbon steel is used to form the conditioning element 550. Diamond tips having a diameter between approximately 40 and 80 mesh, corresponding to between about 192 and 428 microns, can be attached to the tip portion 580 such as by brazing, sintering, or electroplating. Other bonding methods may be used. The diamond size and quality, or shape, can be varied to adjust the aggressiveness of the conditioning process.

Compliant membrane 520 may be formed from a rubber, a plastic, a metal, or a combination of materials, such as a composite or carbon fiber matrix. In one embodiment, the compliant membrane is made of a rubber and provides a flexure between of between approximately 0.1 mil to 10 mils between adjacent conditioning elements 550. Generally, an acceptable flexure is between approximately 2 and 6 mils. Moreover, at a selected chamber pressure, such as 5 psi, the compliant membrane 520 is pressed against the base portions of the conditioning elements 550. These base portions have a diameter between approximately 0.3 to 0.6 inches and, in one aspect, the pressure within the chamber is controlled to impart a force of approximately 1.5 pounds on the base portion 570 of each conditioning elements 550.

Thus, the downward force on the compliant membrane 520 and the conditioning elements 550 may be controlled. Additionally, the absolute diamond height may be modified and controlled by variation of the thickness or compliancy of the compliant inserts 565. In this way, a substantially equal absolute diamond height distribution of the protruding conditioning elements 550 may be attained and the penetration of the tip portions 570 into the pad material may likewise be controlled.

Figure 4:
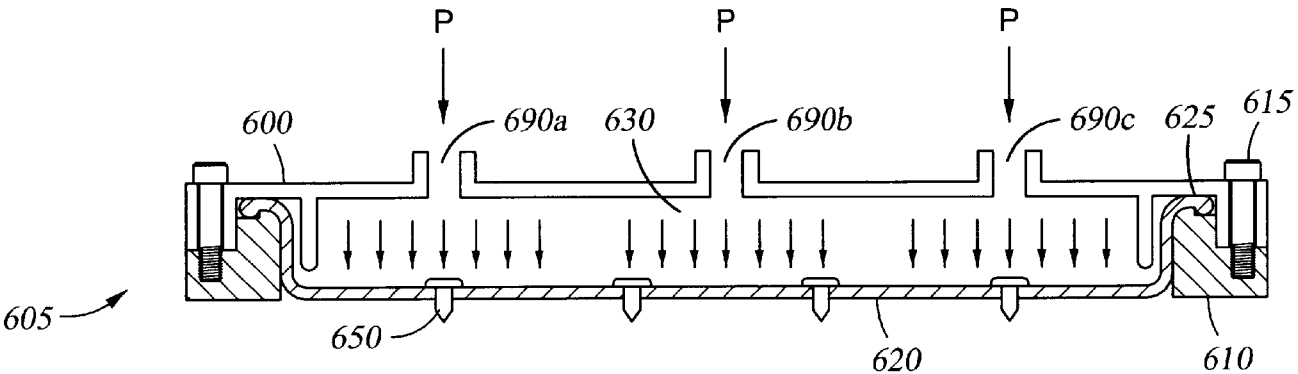
FIG. 4 shows another embodiment of an end effector of the present invention.

FIG. 4 illustrates a simplified view of another embodiment of the end effector 605 of the present invention. The end effector 605 includes a top portion 600 and connecting member 610 connected by bolts 615 to cooperatively form a membrane clamp 625 securing the ends of a compliant membrane 620. The compliant membrane 620 extends substantially from one end of the end effector 605 to the other end thereof and is formed and positioned to present a substantially planar bottom portion. Compliant membrane 620, top portion 600, and membrane clamp 625 cooperatively form a chamber 630.

Conditioning elements 650 have a proximal end secured to the compliant membrane 620, such as by brazing, sintering, or bonding, and a distal end terminating in a point, such as a diamond tip. Conditioning elements 650 may be arranged to possess a tiered absolute diamond height distribution including a plurality of groupings of a substantially equal absolute diamond height. The absolute diamond heights of these groupings may be selected such that, as one tier of conditioning element 650 tips reach a predetermined level of wear or rounding, a subsequent tier of conditioning elements 650 having a slightly lower absolute diamond height becomes engageable with a polishing pad. For example, using the example in FIG. 1(*c*), one tier of conditioning elements 550 may possess an absolute diamond height of 4.0 mil with each subsequent tier of conditioning elements decremented by an additional 0.2 mil. The absolute diamond height distribution of all of the conditioning elements 650 may also be substantially equal.

Compliant membrane 620 may be formed from a rubber, a plastic, a metal, or a combination of materials, such as a composite or carbon fiber matrix. In one embodiment, the compliant membrane is made of a thin metal providing a flexure between of between approximately 0.1 mil to 10 mils between adjacent conditioning elements 650.

A fluid delivery circuit supplies a fluid from a fluid source to the chamber 630 through one or more ports 690*a*, 690*b*, and 690*c* to pressurize chamber 630 to a predetermined pressure P to provide a substantially uniform pressure distribution against the base portions of the conditioning elements 650 and control a tip position thereof. Further to the selection of absolute diamond height as described above, the pressure of chamber 630 may be controlled to tailor the pad conditioning action of the end effector 605. In operation, the end effector 605 is positioned with the tip portions in contact with the polishing pad and the chamber is pressurized to force compliant membrane 620 toward the polishing pad so as to engage the tips of the conditioning elements 650 with the pad. The downward force may be controlled to regulate a penetration of the tips into the pad material. Conditioning of the pad is proportional to the force applied by conditioning elements 650 and may be approximated by $F_D = {}^{AEx}/_{L}$, where E is Young's modulus for the pad material, A is a contact area between a diamond tip and the pad material, L is a depth of material influencing diamond penetration, and x is the displacement or penetration distance. Force $F_D$ is also related to the chamber pressure, the number and distribution of the conditioning elements 650, and the material properties of the selected compliant membrane 620.

Further, a method for conditioning a polishing surface of a polishing pad according to the present invention includes steps of pressurizing a cavity within an end effector to provide, among a plurality of conditioning elements having tip portions protruding from a bottom portion of the end effector, a substantially uniform distribution in absolute diamond heights and/or a substantially uniform force distribution among groupings of conditioning elements. Conditioning of the polishing pad is achieved by placing the tip portions in contact with the polishing surface of the polishing pad. The pressure may be regulated to control a penetration depth of the tip portions. In this method, the end effector may also be rotated about an axis substantially perpendicular to a polishing pad. As discussed above, variations to the method include process control steps such as pressurization of the chamber to a pressure between approximately 1 and 20 psi.

Thus, the pad conditioning assembly of the present invention provides an apparatus and associated method for achieving a substantially uniform absolute diamond height distribution of conditioning elements, a tiered absolute diamond height distribution of the conditioning elements including a plurality of groupings of a substantially equal absolute diamond height, and a substantially uniform force distribution among conditioning elements engageable with a pad to be conditioned. This control over conditioning element absolute diamond height and/or penetration depth improves pad conditioning and can extend the operating life of the conditioning pad. Further, the above aspects of the invention permit maximization of the period of time between pad conditioner services and improvement in throughput.

The invention has described several aspects of the present invention to illustrate modes contemplated for carrying out the invention defined by the claims. As will be realized, the invention is capable of other and different embodiments, and its several details are capable of modifications in various obvious respects, all without departing from the invention and the drawings and description are to be regarded as illustrative in nature. For example, the movable conditioning elements may be moved relative to the end effector and one another by means other than a pressurized fluid, as embodied in the examples above, such as but not limited to actuators or springs associated with individual conditioning elements or groups of conditioning elements. Accordingly, the present invention is not limited by the specific aspects presented and described herein and is instead defined by the claims.

What is claimed is:

1. A pad conditioning assembly comprising:

a conditioner head with an end effector that is movable into contact with a polishing pad;

a plurality of downwardly projecting movable conditioning elements disposed through a bottom of the end effector; and at least one compliant backing member disposed within an interior portion of the end effector and above the conditioning elements, wherein forces applied by the at least one compliant backing member are transferred to the movable conditioning elements to move the conditioning elements.

2. A pad conditioning assembly according to claim 1, further comprising:

a pressurization circuit for applying a pressure from a pressure source to the compliant backing member to flex the compliant backing member against the movable conditioning elements.

3. A pad conditioning assembly according to claim 2:

wherein the end effector includes a plurality of through holes formed in a bottom portion thereof, wherein the end effector includes a chamber formed in an interior portion thereof adjacent the bottom portion, and wherein at least one compliant backing member is disposed within the chamber and adjacent the bottom portion of the end effector.

4. A pad conditioning assembly according to claim 3:

wherein the plurality of movable conditioning elements comprise a flanged base portion, a shaft portion, and a tip portion, and wherein the conditioning elements are movably disposed within the through holes.

5. A pad conditioning assembly according to claim 4, wherein:

the plurality of conditioning elements extend downwardly through the holes; and the flanged base portions of the conditioning elements are biased downwardly by the compliant backing member.

6. A pad conditioning assembly according to claim 5, comprising:

a controller controlling the chamber pressure, wherein the chamber pressure applied to the compliant backing member provides a substantially equal absolute height among the conditioning elements.

7. A pad conditioning assembly according to claim 6, wherein the plurality of conditioning elements comprises between 10 and 100 conditioning elements.

8. A pad conditioning assembly according to claim 6, wherein the tip portions comprise diamond tips.

9. A pad conditioning assembly according to claim 8, wherein the diamond tips comprise diamonds having a diameter of between approximately 40 and 80 mesh.

10. A pad conditioning assembly according to claim 6, wherein the compliant backing member is formed from at least one of a rubber, a plastic, a carbon fiber matrix, and a metal.

11. A pad conditioning assembly according to claim 10, wherein the compliant backing member provides a flexure between approximately 0.1 mil to 10 mils between adjacent conditioning elements.

12. A pad conditioning assembly according to claim 6, wherein the pressurization circuit is provided to pressurize the chamber to a pressure between approximately 1 and 20 psi.

13. A pad conditioning assembly according to claim 6, wherein the plurality of conditioning elements and the corresponding through holes are distributed in a higher density toward an inner diameter of the bottom portion than toward an outer diameter thereof.

14. A pad conditioning assembly comprising:

a conditioner head with an end effector that is movable into contact with a polishing pad;

a plurality of downwardly-projecting conditioning elements;

a compliant backing member disposed within an interior portion of the end effector and adapted to urge a first end of the conditioning elements into contact with the polishing pad; and at least one pressurization port disposed through the interior portion of the end effector.

15. A pad assembly according to claim 14, further comprising:

a chamber formed within the interior portion of the end effector;

a pressurization circuit for supplying a pressure from a pressure source to the chamber to pressurize the chamber to a predetermined pressure, wherein the compliant backing member is disposed adjacent the chamber.

16. A pad conditioning assembly according to claim 15, wherein the conditioning elements have a proximal end contacted by the compliant backing member and a distal end terminating in a point; and wherein pressurization of the chamber flexes the compliant backing member to provide a substantially uniform force distribution among conditioning elements engageable with a pad to be conditioned to regulate penetration depth of the conditioning element points into the pad.

17. A pad conditioning assembly according to claim 16, wherein the compliant backing member is formed from at least one of a rubber, a plastic, a carbon fiber matrix, and a metal.

18. A pad conditioning assembly according to claim 17, comprising between 10 and 100 conditioning elements.

19. A pad conditioning assembly according to claim 18, wherein the points of the conditioning elements comprise diamond tips.

20. A pad conditioning assembly according to claim 19, wherein the compliant backing member provides a flexure of approximately 0.1 mil to 10 mils between adjacent conditioning elements.

21. A pad conditioning assembly, comprising:

a conditioner head with an end effector that is movable into contact with a polishing pad;

a chamber defined within the end effector;

a compliant backing member disposed within the chamber;

a plurality of downwardly-projecting pneumatically movable conditioning elements disposed through holes in the end effector; and a pressurization circuit for selectively changing a pressure within the plenum, wherein pressure changes within the plenum urge the compliant backing against the conditioning elements to move the conditioning elements relative to the end effector.

22. A pad conditioning assembly according to claim 21, wherein the pressurization circuit comprises a pressure source, a controller for controlling the chamber pressure, and a conduit between the pressure source and the end effector to provide a pressure from the pressure source to the end effector.

23. A pad conditioning assembly according to claim 22, wherein the downwardly-projecting pneumatically movable conditioning elements are positioned to have a substantially equal absolute height.

24. A pad conditioning assembly according to claim 23, wherein the plurality of conditioning elements comprises between 10 and 100 conditioning elements.

25. A pad conditioning assembly according to claim 24, wherein the conditioning elements comprise diamond tip portions having a diameter of between approximately 40 and 80 mesh.

26. A pad conditioning assembly, comprising:

a conditioner head with an end effector movable into contact with a polishing pad; and a plurality of downwardly-projecting movable conditioning elements retained by the end effector, each conditioning element having a diamond tip adapted to contact the polishing pad, wherein the plurality of conditioning elements are independently movable relative to the end effector during processing.

27. A pad conditioning assembly according to claim 26, further comprising:

at least one forcing member configured to apply a force to at least one selected conditioning element to move the at least one selected conditioning element with respect to the end effector.

28. A pad conditioning assembly according to claim 26, further comprising:

a plurality of forcing members configured to apply a force to selected conditioning elements to move the selected conditioning elements with respect to the end effector.

29. A pad conditioning assembly according to claim 28, further comprising:

a chamber formed in an interior portion of the end effector adjacent at least one conditioning element, wherein the forcing member comprises a pressure source, a controller for controlling a pressure within the chamber, and a conduit between the pressure source and the chamber to provide a pressure from the pressure source to the chamber.

30. A pad conditioning assembly according to claim 29, further comprising:

at least one compliant member disposed adjacent at least one conditioning element to form a pressure boundary between the chamber and the at least one conditioning element, wherein a pressure within the chamber acts upon the at least one compliant member to move the conditioning element relative to the end effector.

31. A pad conditioning assembly according to claim 30, wherein the conditioning elements are positioned to have a substantially equal absolute height.

32. A method for conditioning a polishing pad, comprising:

urging a compliant backing membrane disposed within an interior portion of an end effector against a plurality of vertically movable conditioning elements having tip portions protruding from a bottom portion of the end effector and retained by the end effector;

bringing the conditioning elements into contact with the polishing pad;

causing relative motion between the polishing pad and the conditioning elements; and causing relative motion between at least one of the vertically movable conditioning elements and the end effector during conditioning of the polishing pad.

33. A method for conditioning a polishing pad according to claim 32, further comprising:

pressurizing a chamber within the end effector to flex the compliant backing membrane against at least one of the conditioning elements.

34. A method for conditioning a polishing pad according to claim 33, comprising:

pressurizing a chamber within the end effector to provide a substantially uniform absolute height distribution among a plurality of conditioning elements.

35. A method for conditioning a polishing pad according to claim 33, comprising:

pressurizing a chamber within the end effector to provide a substantially uniform force distribution among a plurality of the conditioning elements.

36. A method for conditioning a polishing pad, comprising:

bringing a plurality of conditioning elements that are contacted by a compliant backing member disposed within an end effector into contact with the polishing pad; and causing relative motion between the polishing pad and the conditioning elements.

37. A method for conditioning a polishing pad according to claim 36, comprising pressurizing a chamber within the end effector to flex the compliant backing membrane.

38. A method for conditioning a polishing pad according to claim 37, comprising:

pressurizing a chamber within the end effector to provide, among a plurality of conditioning elements having tip portions protruding from a bottom portion of the end effector, a substantially uniform absolute height distribution.

39. A method for conditioning a polishing pad according to claim 37, comprising:

pressurizing a chamber within the end effector to provide a substantially uniform force distribution among a plurality of conditioning elements having tip portions protruding from a bottom portion of the end effector.

40. A pad conditioning assembly according to claim 21, wherein the conditioning elements further comprise:

a base;

a flange defined on the base;

a shaft, a first end of which extends from the flange; and a tip at a second end of the shaft.

41. A pad conditioning assembly according to claim 40, wherein the base and flange of the conditioning elements define a structure whereby the conditioning elements are retained in the through holes, and the shaft extends through the through holes.

42. A pad conditioning assembly comprising:

a conditioner having a downwardly movable end effector;

a plurality of independent conditioning elements extending downwardly through holes in the bottom of the end effector; and a compliant backing member resiliently engaging an upper end of the conditioning members to urge them downwardly independent of each other.

* * * * *

UNITED STATES PATENT AND TRADEMARK OFFICE

CERTIFICATE OF CORRECTION

PATENT NO. : 6,572,446 B1
DATED : June 3, 2003
INVENTOR(S) : Osterheld et al.

It is certified that error appears in the above-identified patent and that said Letters Patent is hereby corrected as shown below:

Title page,
Item [57], ABSTRACT,
Line 3, please change "pad,a" to -- pad, a --

Column 4,
Line 12, please change "an" to -- end --.
Line 67, please change "serviceAs" to -- service. As --.

Column 6,
Line 19, please delete "35".

Signed and Sealed this

Twenty-third Day of September, 2003

JAMES E. ROGAN
*Director of the United States Patent and Trademark Office*